US010005280B2

(12) United States Patent
Takino et al.

(10) Patent No.: US 10,005,280 B2
(45) Date of Patent: Jun. 26, 2018

(54) LIQUID EJECTING HEAD AND LIQUID EJECTING APPARATUS

(71) Applicant: Seiko Epson Corporation, Tokyo (JP)

(72) Inventors: Fumiya Takino, Shiojiri (JP); Shunsuke Watanabe, Matsumoto (JP); Kenta Anegawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/548,032

(22) PCT Filed: Mar. 24, 2016

(86) PCT No.: PCT/JP2016/001720

§ 371 (c)(1),
(2) Date: Aug. 1, 2017

(87) PCT Pub. No.: WO2016/152166

PCT Pub. Date: Sep. 29, 2016

(65) Prior Publication Data

US 2018/0022097 A1 Jan. 25, 2018

(30) Foreign Application Priority Data

Mar. 26, 2015 (JP) ..... 2015-064144
Feb. 5, 2016 (JP) ..... 2016-020628

(51) Int. Cl.
*B41J 2/14* (2006.01)
*B41J 2/16* (2006.01)

(52) U.S. Cl.
CPC ..... *B41J 2/14233* (2013.01); *B41J 2/1433* (2013.01); *B41J 2/14274* (2013.01);
(Continued)

(58) Field of Classification Search
CPC .. B41J 2/14233; B41J 2/1433; B41J 2/14274; B41J 2002/14491; B41J 2002/14241;
(Continued)

(56) References Cited

U.S. PATENT DOCUMENTS

2011/0199435 A1* 8/2011 Kobayashi ..... B41J 2/14274 347/54

FOREIGN PATENT DOCUMENTS

EP 2594401 A1 5/2013
JP 2001-179973 A 7/2001
(Continued)

OTHER PUBLICATIONS

International Search Report from PCT/JP2016/001720, dated May 31, 2016, 3 pages.

*Primary Examiner* — Geoffrey Mruk
(74) *Attorney, Agent, or Firm* — Workman Nydegger

(57) ABSTRACT

A liquid ejecting head (100) includes a pressure chamber substrate (34) on which pressure chamber spaces (342) are formed; a flow path substrate (32) which includes a first face (F1) on which the pressure chamber substrate (34) is provided, and a second face (F2) on a side opposite to the first face (F1), and on which a space (R1), a supply hole (322) which causes the space (R1) and the pressure chamber space (342) to communicate, and a communicating hole (324) which communicates with the pressure chamber space (342) are formed; a nozzle plate (52) which is provided on the second face (F2), and on which nozzles (N) which communicate with the communicating hole (324) are formed; a housing (40) which is provided on the first face (F1), and in which a space (R2) which communicates with the space (R1) of the flow path substrate (32), and an opening portion (422) which communicates with the space (R2) are formed; a flexible compliance unit (54) which is provided on the second face (F2), and seals the communicating hole (324)
(Continued)

and the space (R1); and a flexible compliance unit (46) which seals the opening portion (422).

7 Claims, 9 Drawing Sheets

(52) U.S. Cl.
CPC ..... *B41J 2/161* (2013.01); *B41J 2/1626* (2013.01); *B41J 2/1632* (2013.01); *B41J 2/1643* (2013.01); *B41J 2002/14241* (2013.01); *B41J 2002/14362* (2013.01); *B41J 2002/14419* (2013.01); *B41J 2002/14459* (2013.01); *B41J 2002/14491* (2013.01)

(58) Field of Classification Search
CPC .... B41J 2002/14362; B41J 2002/14419; B41J 2002/14459
See application file for complete search history.

(56) References Cited

FOREIGN PATENT DOCUMENTS

| | | | |
|---|---|---|---|
| JP | 2002-052713 | A | 2/2002 |
| JP | 2006-062259 | A | 3/2006 |
| JP | 2013-028033 | A | 2/2013 |

* cited by examiner

[Fig. 1]
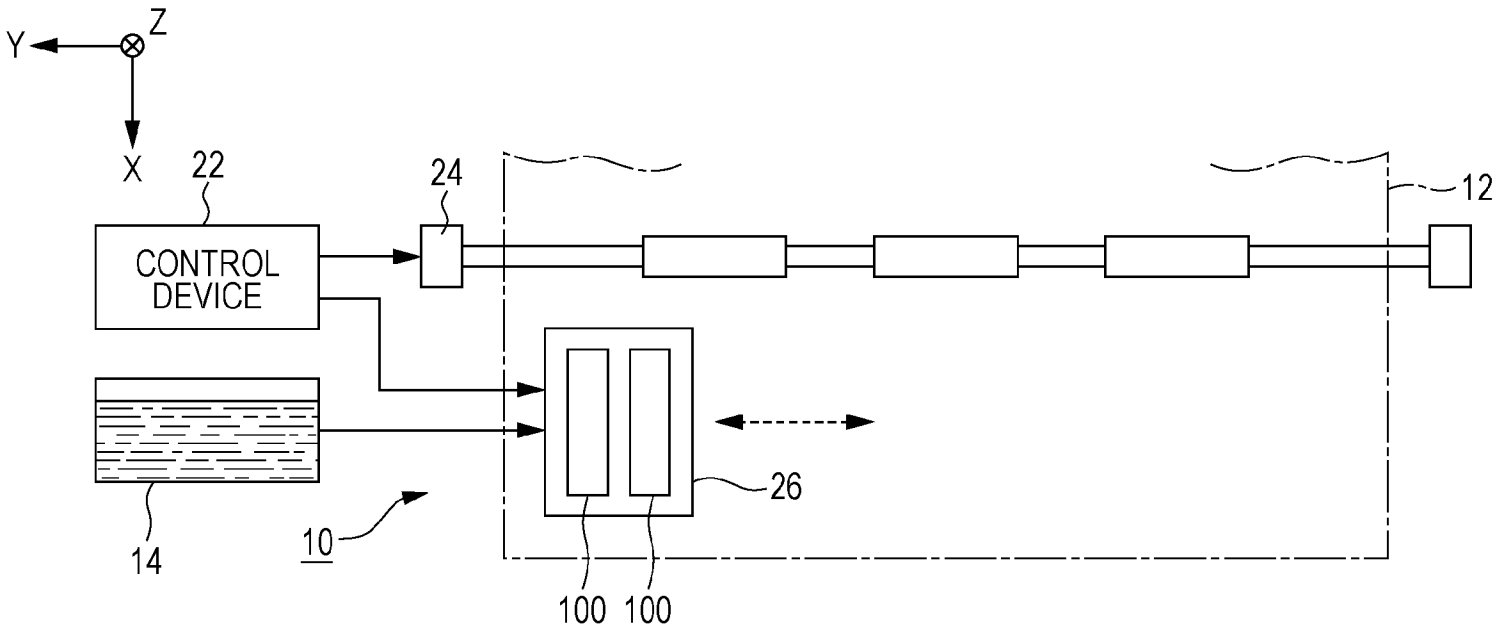

[Fig. 2]
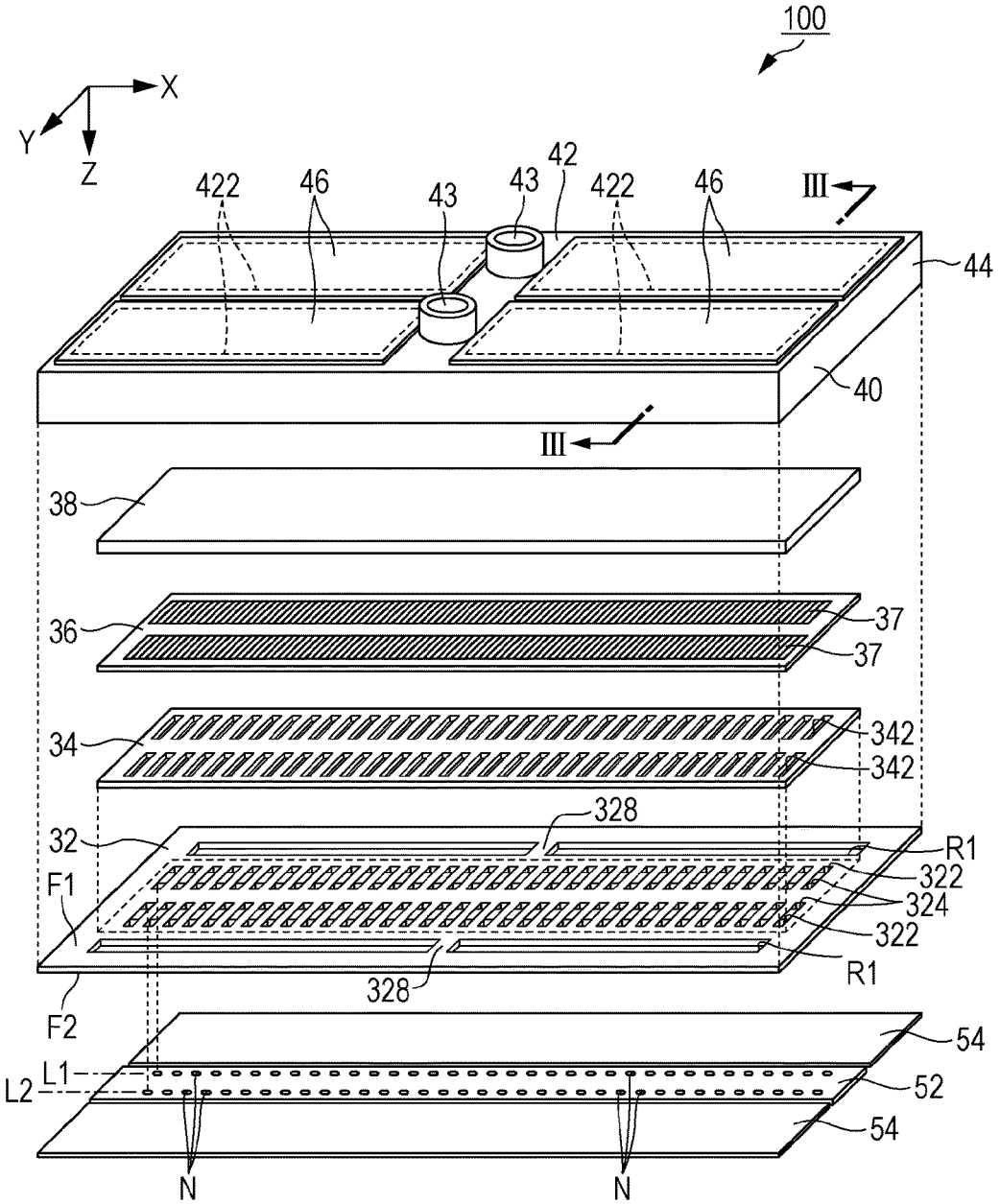

[Fig. 3]
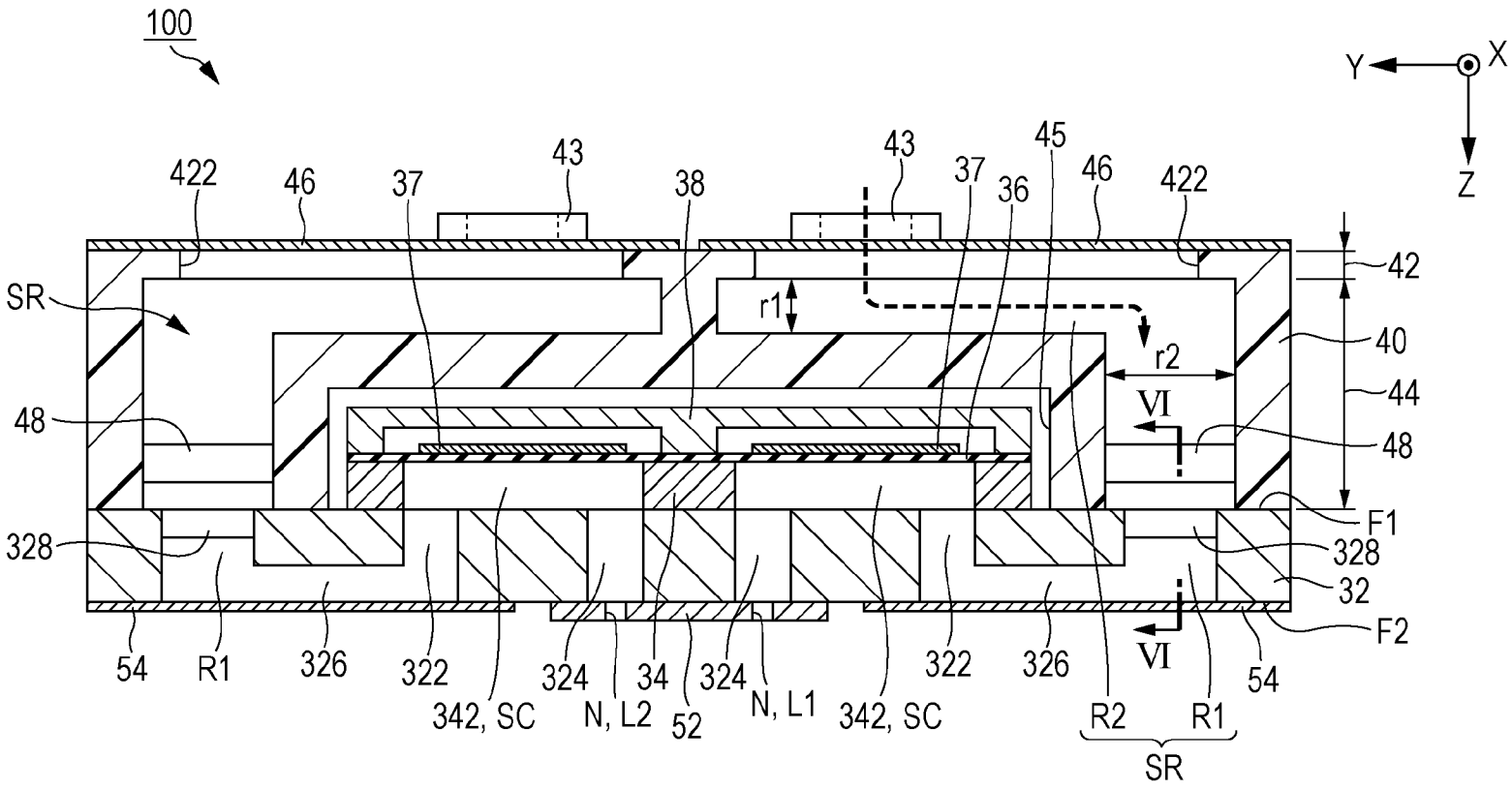

[Fig. 4]
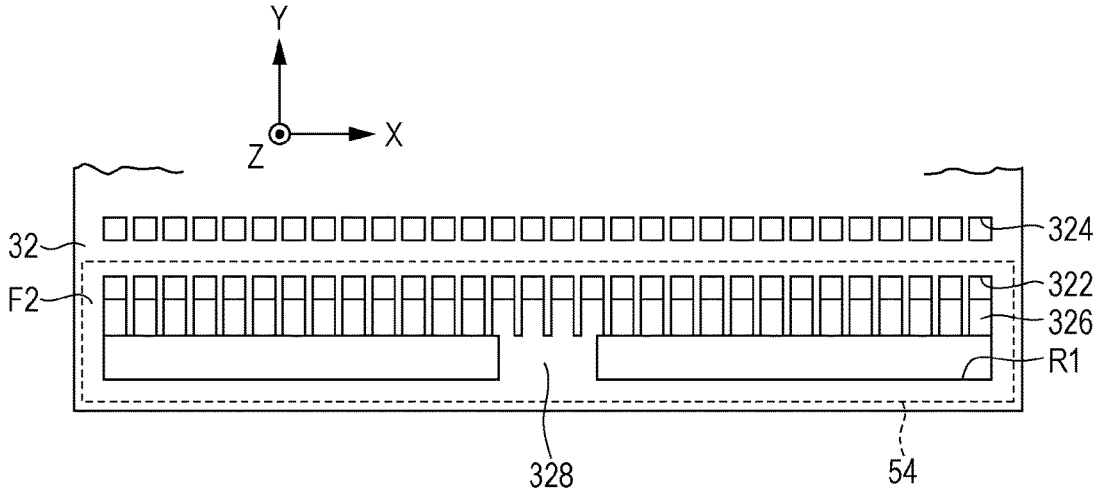
[Fig. 5]
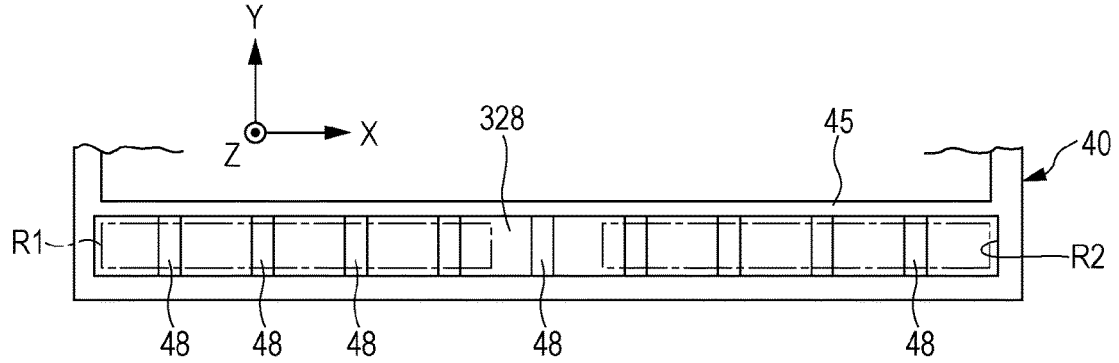

[Fig. 6]
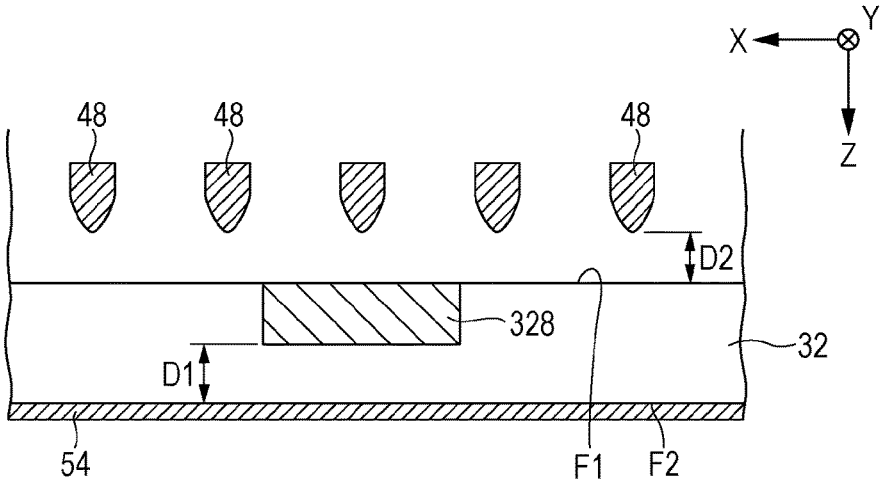
[Fig. 7]
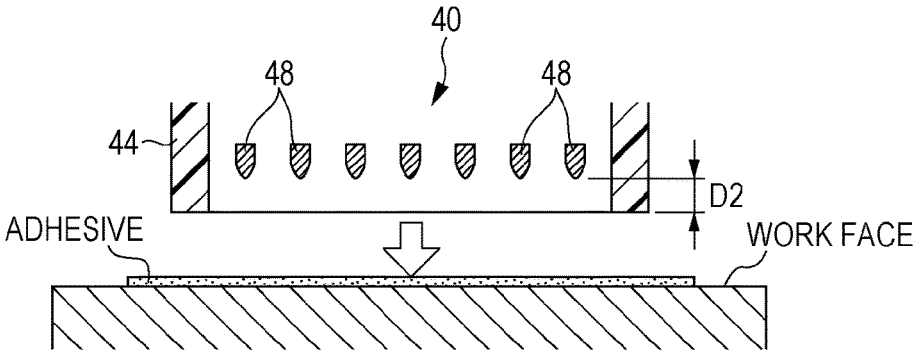

[Fig. 8]
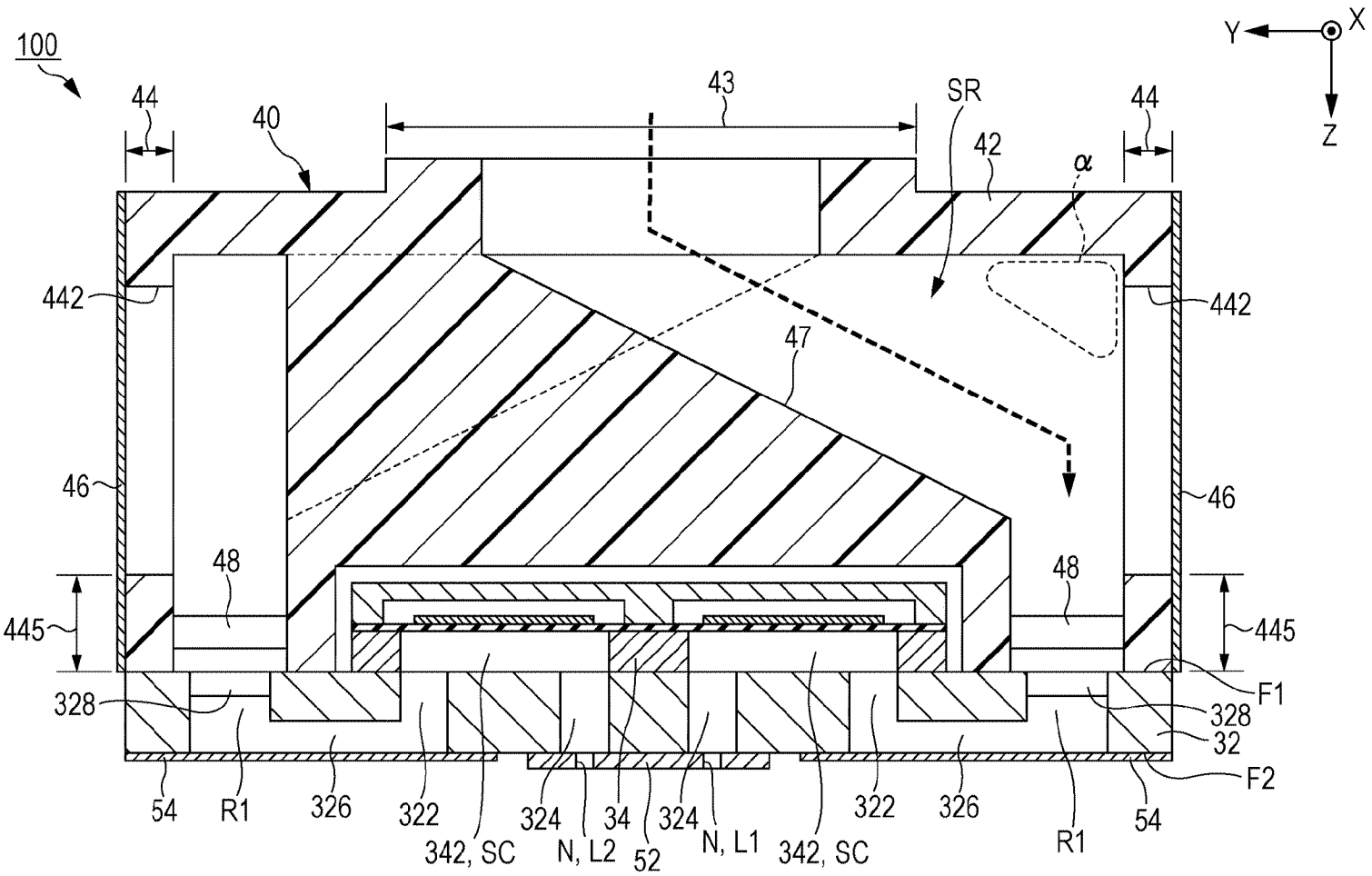

[Fig. 9]
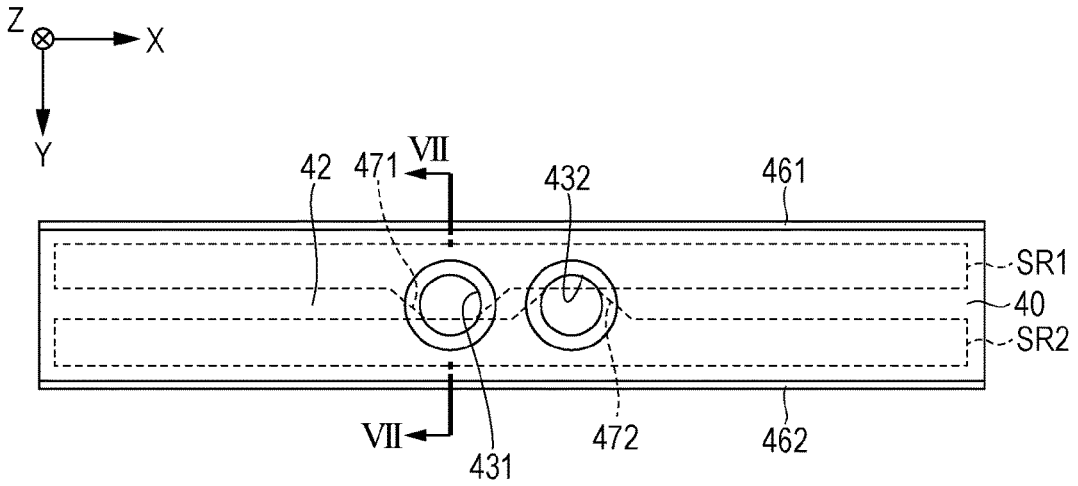

[Fig. 10]
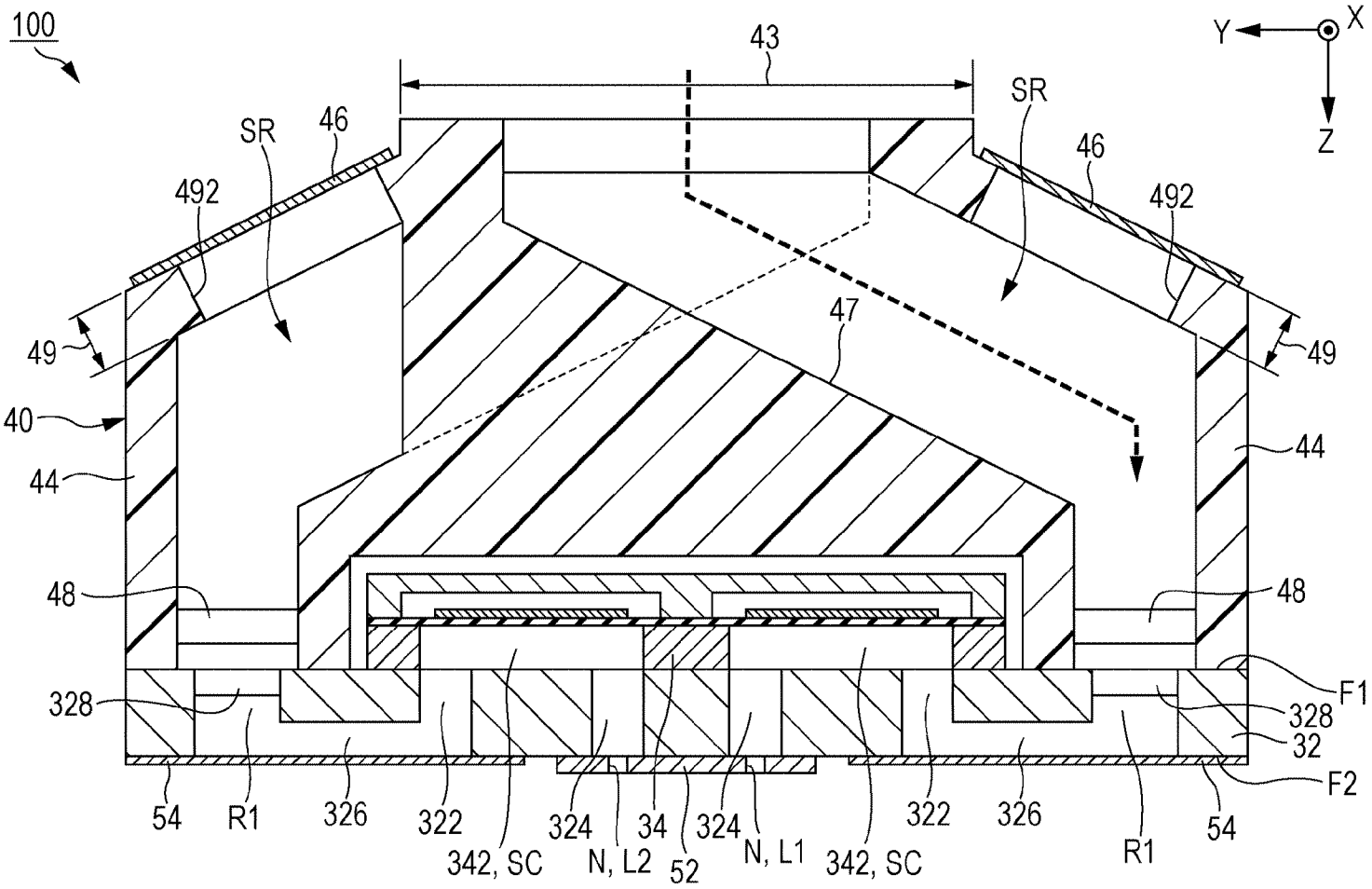

[Fig. 11]
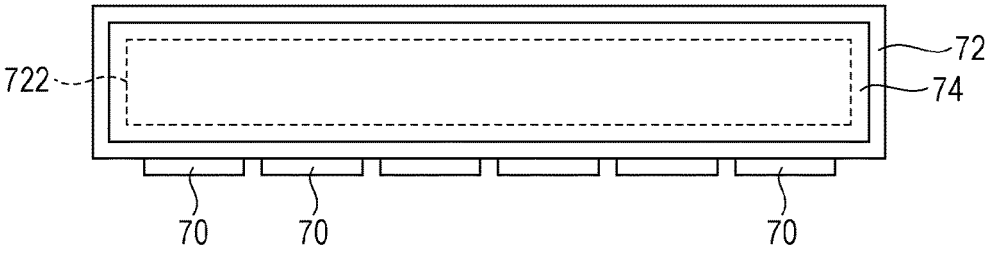

LIQUID EJECTING HEAD AND LIQUID EJECTING APPARATUS

TECHNICAL FIELD

The present invention relates to a technology which ejects liquid such as ink.

BACKGROUND ART

In the related art, a liquid ejecting head which ejects liquid such as ink which is filled in a pressure chamber from nozzles has been proposed. For example, in PTL 1, a structure in which liquid is supplied to a pressure chamber from a common liquid chamber in which a liquid chamber hollow portion which is formed on the communicating substrate, and a liquid chamber forming hollow portion of a unit case which is fixed to the communicating substrate are caused to communicate with each other is disclosed. A compliance sheet which absorbs a pressure change of liquid in the common liquid chamber is provided on the communicating substrate, and configures a base of the common liquid chamber.

CITATION LIST

Patent Literature

PTL 1: JP-A-2013-129191

SUMMARY OF INVENTION

Technical Problem

However, with only a compliance sheet which is provided on a communicating substrate as in PTL 1, it is not easy to sufficiently secure a performance of absorbing a pressure change (volume) in practice. When assuming miniaturization of a liquid ejecting head, since it is necessary to miniaturize the communicating substrate or the compliance sheet, in particular, a deficiency in performance of absorbing a pressure change becomes serious. An object of the present invention is to improve a performance of absorbing a pressure change in liquid, in consideration of the above described circumstances.

Solution to Problem

In order to solve the above described problem, according to an aspect of the present invention, there is provided a liquid ejecting head which includes a pressure chamber substrate on which pressure chamber spaces are formed; a flow path substrate which includes a first face on which the pressure chamber substrate is provided, and a second face on a side opposite to the first face, and on which a first space, a supply hole which causes the first space and the pressure chamber space to communicate, and a communicating hole which communicates with the pressure chamber space are formed; a nozzle plate which is provided on the second face of the flow path substrate, and on which nozzles which communicate with the communicating hole are formed; a housing which is provided on the first face of the flow path substrate, and in which a second space which communicates with the first space of the flow path substrate, and an opening portion which communicates with the second space are formed; a flexible first compliance unit which is provided on the second face of the flow path substrate, and seals the communicating hole and the first space; and a flexible second compliance unit which seals the opening portion of the housing. In the above described configuration, since the second compliance unit which seals the opening portion of the housing is provided, in addition to the first compliance unit which is provided on the second face of the flow path substrate, there is an advantage that it is possible to effectively absorb a pressure change of liquid in the first space and the second space compared to a configuration in which only the first compliance unit is provided.

In a preferable aspect of the invention, the housing includes a top face portion which is located on a side opposite to the flow path substrate by interposing the second space therebetween, the opening portion is formed on the top face portion, and the second compliance unit is provided on an exterior wall face of the top face portion. In the above described aspect, since the second compliance unit is provided on the top face portion of the housing, there is an advantage that it is possible to effectively absorb a pressure change of liquid in the first space and the second space while reducing a height (size in direction perpendicular to first face) of the housing compared to a configuration in which the second compliance unit is provided on a side face portion of the housing, for example.

In a preferable aspect of the invention, the housing includes a side face portion which protrudes from the first face, the opening portion is formed on the side face portion, and the second compliance unit is provided on an exterior wall face of the side face portion. In the above described aspect, since the second compliance unit is provided on the side face portion of the housing, there is an advantage that it is possible to effectively absorb a pressure change of liquid in the first space and the second space while reducing the size of the housing in a plane which is parallel to the first face compared to a configuration in which the second compliance unit is provided on the top face portion of the housing, for example.

In a preferable example of the configuration in which the second compliance unit is provided on the side face portion, the side face portion includes a foundation portion which protrudes from the first face along a peripheral edge of the flow path substrate, and the second compliance unit is provided on the exterior wall face of the side face portion including a front surface of the foundation portion. In the above described aspect, since the second compliance unit is provided on the exterior wall face of the side face portion including the front surface of the foundation portion which protrudes from the first face along the peripheral edge of the flow path substrate, the second compliance unit is firmly fixed compared to a configuration in which the side face portion does not include the foundation portion (for example, configuration in which second compliance unit is provided over both faces of exterior wall face of side face portion and side end face of flow path substrate). Accordingly, there is an advantage that it is possible to reduce a possibility of a malfunction such as leakage of ink, or the like, from a bonding portion of the compliance unit.

In a preferable aspect of the invention, the side face portion includes an inclined portion of which an exterior wall face is inclined to the flow path substrate, the opening portion is formed in the inclined portion, and the second compliance unit is provided on an exterior wall face of the inclined portion. In the above described aspect, since the second compliance unit is provided in the inclined portion which is inclined to the flow path substrate, there are advantages that a size of the housing in the plane which is parallel to the first face is reduced compared to a configuration in which the second compliance unit is provided on the top face portion of the housing, for example, and a height of the housing is reduced compared to a configuration in which the second compliance unit is provided on the side face portion of the housing, for example.

In a preferable aspect of the invention, a liquid ejecting apparatus includes the liquid ejecting head according to each of the above exemplified aspects. A preferable example of the liquid ejecting apparatus is a printing apparatus which ejects ink; however, a use of the liquid ejecting apparatus according to the invention is not limited to printing.

BRIEF DESCRIPTION OF DRAWINGS

FIG. 1 is a configuration diagram of a printing apparatus according to a first embodiment.

FIG. 2 is an exploded perspective view of a liquid ejecting head.

FIG. 3 is a sectional view (sectional view which is taken along line III-III in FIG. 2) of the liquid ejecting head.

FIG. 4 is a plan view of a flow path substrate.

FIG. 5 is a plan view of a housing.

FIG. 6 is a sectional view (sectional view which is taken along line VI-VI in FIG. 3) of the housing and the flow path substrate.

FIG. 7 is an explanatory diagram of a process of providing the housing in the flow path substrate.

FIG. 8 is a sectional view of a liquid ejecting head according to a second embodiment.

FIG. 9 is a plan view of the liquid ejecting head according to the second embodiment.

FIG. 10 is a sectional view of a liquid ejecting head according to a third embodiment.

FIG. 11 is a configuration diagram of a liquid ejecting head according to a modification example.

DESCRIPTION OF EMBODIMENTS

First Embodiment

FIG. 1 is a partial configuration diagram of an ink jet printing apparatus 10 according to a first embodiment of the invention. The printing apparatus 10 according to the first embodiment is a preferable example of a liquid ejecting apparatus which ejects ink as an example of liquid onto a medium (ejecting target) 12 such as a printing sheet, and as exemplified in FIG. 1, the printing apparatus includes a control device 22, a transport mechanism 24, a carriage 26, and a plurality of liquid ejecting heads 100. A liquid container (for example, cartridge) 14 which stores ink is mounted on the printing apparatus 10.

The control device 22 integrally controls each element of the printing apparatus 10. The transport mechanism 24 transports the medium 12 in the X direction under control of the control device 22. Each liquid ejecting head 100 ejects ink onto the medium 12 from a plurality of nozzles under control of the control device 22. The plurality of liquid ejecting heads 100 are mounted on the carriage 26. The control device 22 causes the carriage 26 to reciprocate in the Y direction which intersects the X direction. A desired image is formed on the surface of the medium 12 when each liquid ejecting head 100 ejects ink onto the medium 12 in parallel with transporting of the medium 12 using the transport mechanism 24 and repeated reciprocating of the carriage 26. In addition, hereinafter, a direction which is perpendicular to an X-Y plane (for example, plane parallel to surface of medium 12) will be denoted by a Z direction. An ink ejecting direction (typically, vertical direction) using each liquid ejecting head 100 corresponds to the Z direction.

FIG. 2 is an exploded perspective view of one arbitrary liquid ejecting head 100, and FIG. 3 is a sectional view which is taken along line III-III in FIG. 2. As exemplified in FIG. 2, the liquid ejecting head 100 includes a plurality of nozzles N which are arranged along the X direction. The plurality of nozzles N in the first embodiment are divided into a first column L1 and a second column L2. Positions of the nozzles N in the X direction are different from each other between the first column L1 and the second column L2. That is, the plurality of nozzles N are subjected to a staggered arrangement. As is understood from FIG. 2, the liquid ejecting head 100 according to the first embodiment has a structure in which elements related to the plurality of nozzles N of the first column L1, and elements related to the plurality of nozzles N of the second column L2 are arranged approximately in line symmetry. Therefore, in the following descriptions, the elements related to each nozzle N of the first column L1 will be paid attention to, for convenience, and descriptions of the elements related to each nozzle N of the second column L2 will be appropriately omitted.

As exemplified in FIGS. 2 and 3, the liquid ejecting head 100 according to the first embodiment includes a flow path substrate 32. The flow path substrate 32 is a plate-shaped member which includes a first face F1 and a second face F2. The first face F1 is a surface on the negative side in the Z direction, and the second face F2 is a surface on a side opposite to the first face F1 (positive side in Z direction). A pressure chamber substrate 34, a vibrating unit 36, a plurality of piezoelectric elements 37, a protecting member 38, and a housing 40 are provided on the first face F1 of the flow path substrate 32, and a nozzle plate 52, and a compliance unit 54 (exemplified first compliance unit) are provided on the second face F2. Each of the elements of the liquid ejecting head 100 is schematically a plate-shaped member which is long in the X direction similarly to the flow path substrate 32, and the elements are bonded to each other using an adhesive, for example.

The nozzle plate 52 is a plate-shaped member on which the plurality of nozzles N are formed, and is provided on the second face F2 of the flow path substrate 32 using an adhesive, for example. Each nozzle N is a through hole through which ink passes. The nozzle plate 52 according to the first embodiment is manufactured by processing a single crystal substrate of silicon (Si) using a semiconductor manufacturing technology (for example, etching). However, when manufacturing the nozzle plate 52, it is possible to arbitrarily adopt a well-known material or manufacturing method.

The flow path substrate 32 is a plate-shaped member for forming a flow path of ink. FIG. 4 is a plan view of the second face F2 of the flow path substrate 32. As exemplified in FIGS. 2 to 4, a space R1 (exemplified first space), a plurality of supply holes 322 and a plurality of communicating holes 324 are formed in the flow path substrate 32 according to the first embodiment. The space R1 is an opening which is formed in a long shape along the X direction in a planar view (that is, when viewed in Z direction), and the supply holes 322 and the communicating holes 324 are through holes (opening which is formed over the first face F1 and second face F2) which are formed in each nozzle N. The plurality of supply holes 322 are arranged in the X direction, and the plurality of communicating holes 324 are also formed in the X direction, similarly. Arrangements of the plurality of supply holes 322 are located between arrangements of the plurality of communicating holes 324 and the space R1. In addition, as illustrated in FIGS. 3 and 4, a plurality of branching paths 326 which correspond to supply holes 322 which are different from each other are formed on the second face F2 of the flow path substrate 32. Each branching path 326 is a groove-shaped flow path which extends along the Y direction so as to connect the space R1 to the supply hole 322. Meanwhile, one arbitrary communicating hole 324 overlaps one nozzle N in a planar view. That is, a nozzle N communicates with a communicating hole 324.

As exemplified in FIGS. 2 and 3, the pressure chamber substrate 34 is a plate-shaped member on which a plurality of pressure chamber spaces 342 are arranged along the X direction, and is provided on the first face F1 of the flow path substrate 32 using an adhesive, for example. The pressure chamber space 342 is a long through hole which goes along the Y direction in a planar view which is formed in each nozzle N. As illustrated in FIG. 3, an end portion on a positive side of one arbitrary pressure chamber space 342 in the Y direction overlaps one communicating hole 324 of the flow path substrate 32 in a planar view. Accordingly, a pressure chamber space 342 and a nozzle N communicate with each other through the communicating hole 324.

On the other hand, an end portion on the negative side of the pressure chamber space 342 in the Y direction overlaps one supply hole 322 of the flow path substrate 32 in a planar view. As is understood from the above descriptions, since the supply hole 322 according to the first embodiment functions as a diaphragm flow path which causes the space R1 and the pressure chamber space 342 to communicate at a predetermined flow path resistance, it is not necessary to form a diaphragm flow path in the pressure chamber substrate 34. Therefore, a simple rectangular pressure chamber space 342 of which a width is maintained at a predetermined flow path width is formed in the pressure chamber substrate 34 according to the first embodiment over the entire length in the Y direction. That is, the diaphragm flow path in which a flow path area is partially constricted is not formed in the pressure chamber substrate 34. Accordingly, it is possible to reduce a size of the pressure chamber substrate 34 compared to a configuration in which the diaphragm flow path is formed in the pressure chamber substrate 34, and to realize miniaturization of the liquid ejecting head 100.

The flow path substrate 32 and the pressure chamber substrate 34 are manufactured by processing a single crystal substrate of silicon (Si) using a semiconductor manufacturing technology, for example, similarly to the above described nozzle plate 52. However, when manufacturing the flow path substrate 32 and the pressure chamber substrate 34, it is possible to arbitrarily adopt a well-known material or manufacturing method.

As exemplified in FIGS. 2 and 3, the vibrating unit 36 is provided on the surface of the pressure chamber substrate 34 on a side opposite to the flow path substrate 32. The vibrating unit 36 according to the first embodiment is a plate-shaped member (vibrating plate) which can be elastically vibrated. In addition, in FIGS. 2 and 3, a configuration in which the vibrating unit 36 which is separately formed from the pressure chamber substrate 34 is fixed to the pressure chamber substrate 34 is illustrated; however, it is also possible to integrally form the pressure chamber substrate 34 and the vibrating unit 36 by selectively removing a part of a region corresponding to the pressure chamber space 342 in the plate thickness direction, in a plate-shaped member with a predetermined plate thickness.

As is understood from FIG. 3, the first face F1 of the flow path substrate 32 and the vibrating unit 36 face each other with an interval in the inside of each pressure chamber space 342 of the pressure chamber substrate 34. A space between the first face F1 of the flow path substrate 32 and the vibrating unit 36 in the inside of each pressure chamber space 342 functions as a pressure chamber SC for applying pressure to ink which is filled in the space. The pressure chamber SC is individually formed in each nozzle N. As is understood from the above descriptions, the pressure chamber space 342 formed in the pressure chamber substrate 34 is a space which is formed so as to be the pressure chamber SC.

As exemplified in FIGS. 2 and 3, the plurality of piezoelectric elements 37 which correspond to nozzles N which are different from each other are provided on a plane of the vibrating unit 36 on a side opposite to the pressure chamber SC. The piezoelectric element 37 is a passive element which is vibrated when a driving signal is supplied. The plurality of piezoelectric elements 37 are arranged in the X direction so as to correspond to each pressure chamber SC. The piezoelectric element 37 according to the first embodiment is configured of a pair of electrodes which face each other, and a piezoelectric layer which is stacked between the electrodes. The protecting member 38 in FIGS. 2 and 3 is a structure body for protecting the plurality of piezoelectric elements 37, and is fixed to the surface of the vibrating unit 36 using an adhesive, for example. The plurality of piezoelectric elements 37 are accommodated in the inside of a space (recessed portion) which is formed on a face of the protecting member 38 which faces the vibrating unit 36.

The housing 40 is a case for storing ink which is supplied to the plurality of pressure chambers SC. The surface of the housing 40 on the positive side in the Z direction (hereinafter, also referred to as "bonding face") is fixed to the first face F1 of the flow path substrate 32 using an adhesive, for example. The housing 40 according to the first embodiment is formed of a material which is different from that of the flow path substrate 32 or the pressure chamber substrate 34. For example, it is possible to manufacture the housing 40 using injection molding, using a resin material, for example. However, when manufacturing the housing 40, it is possible to arbitrarily adopt a well-known material or manufacturing method.

As a material of the housing 40, for example, a synthetic fiber such as poly(p-phenylenebenzobisoxazole)(a.k.a. Zylon [registered trademark], hereinafter "PBO fiber") or a resin material such as liquid crystal polymer can be suitably employed. However, considering various advantages described below, LCP is more suitable as the material of the housing 40, compared with the PBO fiber.

- Since liquid crystal polymer (LCP) has a lower linear expansion coefficient than that of the PBO fiber, it is possible to suppress thermal deformation of the housing 40 (especially warpage for the flow path substrate 32).
- Since LCP has a lower viscosity and a higher liquidity than those of the PBO fiber (i.e. it can sufficiently reach the whole area of an injection mold), it is possible to suppress dimensional errors or molding failure occurring in the housing 40.
- Since a viscosity of LCP increases steeply when cooling compared with the PBO fiber (i.e. it is solidified rapidly), it is possible to suppress burrs occurring due to the material entering into gaps of the molding during a cooling process, and it is also possible to reduce the time required for forming the housing 40.

Since LCP has a lower permeability for fluid (e.g. water) or gas (e.g. steam or oxygen) than that of the PBO fiber, it is possible to prevent fluid or gas from entering into the housing 40.

Since LCP has a lower reactivity to various types of ink including the solvent ink while the PBO fiber tends to react with, for example, a solvent ink easily, it is possible to suppress deterioration of the housing 40 over time due to attachment of the ink.

FIG. 5 is a plan view of the housing 40 which is viewed from the flow path substrate 32 side (positive side in Z direction). As exemplified in FIGS. 3 and 5, the housing 40 according to the first embodiment is a structure body in which a space R2 (exemplified second space) is formed. The space R2 is a recessed portion to which the flow path substrate 32 side is open, and is formed in a long shape in the X direction. As illustrated in FIG. 3, for example, the space R2 includes a first portion r1 and a second portion r2. The second portion r2 is a space on the flow path substrate 32 side (downstream side in flowing of ink) when viewed from the first portion r1. In addition, an accommodating space 45 which accommodates the protecting member 38 and the pressure chamber substrate 34 is formed between a space R2 corresponding to the first column L1 and a space R2 corresponding to the second column L2.

As exemplified in FIGS. 2 and 3, the housing 40 according to the first embodiment includes a top face portion 42 and a side face portion 44. The side face portion 44 is a portion which is fixed to the first face F1 so as to protrude from the first face F1 on the negative side in the Z direction along the peripheral edge of the flow path substrate 32. The base of the side face portion 44 is bonded to the first face F1 of the flow path substrate 32 as a bonding face. As is understood from FIG. 3, an outer wall face of the side face portion 44 (surface on a side opposite to inner wall face on space R2 side), and a side end face of the flow path substrate 32 are located on approximately the same plane (so-called flush surface). That is, an external shape of the flow path substrate 32 and an external shape of the housing 40 which are viewed in the Z direction practically match each other, and the external shape of the housing 40 does not protrude on the outer side of the outer peripheral edge of the flow path substrate 32. Accordingly, there is an advantage that it is possible to miniaturize the liquid ejecting head 100 compared to a configuration in which the housing 40 is larger than the flow path substrate 32.

The top face portion 42 of the housing 40 is a portion which is located on a side opposite to the flow path substrate 32 by interposing the space R2 therebetween. A space which is surrounded with the side face portion 44 and the top face portion 42 corresponds to the space R2. As exemplified in FIGS. 2 and 3, an introducing port 43 is formed on the top face portion 42 in the first embodiment. The introducing port 43 is a tubular portion which causes the space R2 of the housing 40 and the outside of the housing 40 to communicate. As is understood from FIG. 3, the introducing port 43 according to the first embodiment is located on a side opposite to the side face portion 44 (positive side in Y direction) by interposing the second portion r2 of the space R2 therebetween in a planar view, and communicates with the first portion r1 in the space R2.

As exemplified in FIG. 3, the space R1 of the flow path substrate 32 and the space R2 of the housing 40 communicate with each other. A space which is formed by the space R1 and the space R2 functions as a liquid storage chamber (reservoir) SR. The liquid storage chamber SR is a common liquid chamber which extends over the plurality of nozzles N, and stores ink which is supplied to the introducing port 43 from the liquid container 14. As described above, the introducing port 43 is located on the positive side of the second portion r2 in the Y direction. Accordingly, as illustrated in FIG. 3 using a dashed arrow, ink which is supplied to the introducing port 43 from the liquid container 14 flows to the side face portion 44 side (negative side in Y direction) in the first portion r1 of the space R2, reaches the second portion r2, and flows to the positive side in the Z direction in the second portion r2. That is, a flow path which goes from the introducing port 43 toward the side face portion 44 side is formed in the housing 40. In addition, ink which is stored in the liquid storage chamber SR is supplied to each pressure chamber SC in parallel, is filled in the pressure chamber by passing through the supply hole 322 after being branched off into the plurality of branching paths 326, and is ejected to the outside from the pressure chamber SC by passing through the communicating hole 324 and the nozzle N due to a pressure change which corresponds to a vibration of the vibrating unit 36. That is, the pressure chamber SC functions as a space in which a pressure for ejecting ink from the nozzle N is generated, and functions as a space in which ink to be supplied to the plurality of pressure chambers SC is stored (common liquid chamber).

As exemplified in FIGS. 2 and 3, the compliance unit 54 is provided on the second face F2 of the flow path substrate 32. The compliance unit 54 is a flexible film, and functions as a vibration absorbing body which absorbs a pressure change of ink in the liquid storage chamber SR (space R1). As illustrated in FIG. 3, the compliance unit 54 configures a base of the liquid storage chamber SR by being provided on the second face F2 of the flow path substrate 32 so as to seal the space R1 of the flow path substrate 32, the plurality of branching paths 326, and the plurality of communicating holes 324. That is, the pressure chamber SC faces the compliance unit 54 through the communicating hole 324. In addition, in the illustration in FIG. 2, a space R1 corresponding to the first column L1 and a space R1 corresponding to the second column L2 are sealed with a separate compliance unit 54; however, it is also possible to cause one compliance unit 54 to be continuous over both of the spaces R1.

Meanwhile, as exemplified in FIGS. 2 and 3, an opening portion 422 is formed on the top face portion 42 of the housing 40. Specifically, the opening portions 422 are formed on the positive side and the negative side in the X direction by interposing the introducing port 43 therebetween. The opening portion 422 is an opening which causes the space R2 of the housing 40 and an external space of the housing 40 to communicate. As illustrated in FIG. 2, a compliance unit 46 (exemplified second compliance unit) is provided on the surface of the top face portion 42. The compliance unit 46 is a flexible film which functions as a vibration absorbing body which absorbs a pressure change of ink in the liquid storage chamber SR (space R2), and configures a wall face (specifically, ceiling) of the liquid storage chamber SR by being provided on the outer wall face of the top face portion 42 so as to seal the opening portion 422. The compliance unit 46 according to the first embodiment is located on the upstream side of the compliance unit 54 in the liquid storage chamber SR, and is arranged in parallel to the first face F1 of the flow path substrate 32 or the compliance unit 54. In addition, in the illustration in FIG. 2, an individual compliance unit 46 is provided in each opening portion 422; however, it is also possible to adopt a configuration in which one compliance unit 46 is continuous over the plurality of opening portions 422. As is understood from the above descriptions, according to the first embodiment, the compliance units 54 and 46 are provided in order to suppress a pressure change in the liquid storage chamber SR.

As exemplified in FIGS. 2 to 4, a beam-shaped unit 328 is provided in the space R1 of the flow path substrate 32. According to the first embodiment, one beam-shaped unit 328 is formed at a position at the center of the space R1 in the X direction. The beam-shaped unit 328 is a beam-shaped portion in the space R1 which is stretched between a pair of inner wall faces which face each other with an interval in the Y direction. That is, the beam-shaped unit 328 is formed in a shape which reaches the other side from one side of the pair of inner wall faces which are parallel to an X-Z plane in the space R1 by protruding in the Y direction. As illustrated in FIGS. 2 and 4, the space R1 can be expressed as a structure in which the space is divided into two spaces by setting the beam-shaped unit 328 as a boundary. The beam-shaped unit 328 according to the first embodiment is integrally formed with the flow path substrate 32 by machining a silicon single crystal substrate. In addition, a configuration in which one beam-shaped unit 328 is formed in the space R1 is illustrated in FIG. 4; however, it is also possible to form a plurality of the beam-shaped units 328 in the space R1 with an interval in the X direction.

As exemplified in FIGS. 3 and 5, a plurality of beam-shaped units 48 are formed in the space R2 of the housing 40. The beam-shaped unit 48 is a beam-shaped portion of the space R2 which is stretched over a pair of inner wall faces which face each other with an interval in the Y direction. That is, the beam-shaped unit 48 is formed in a shape which reaches the other side from one side of the pair of inner wall faces which are parallel to an X-Z plane in the space R2 by protruding in the Y direction. The plurality of beam-shaped units 48 are provided in the space R2 with an interval in the X direction. That is, according to the first embodiment, the beam-shaped units 48 of a total number which exceeds the number of beam-shaped units 328 of the flow path substrate 32 are provided in the housing 40. The beam-shaped unit 328 according to the first embodiment is integrally formed with the housing 40 using injection molding, using a resin material, for example.

FIG. 6 is a sectional view which is taken along line VI-VI in FIG. 3. That is, a structure of a section which passes through the space R1 of the flow path substrate 32 and the space R2 of the housing 40 is illustrated in FIG. 6. As exemplified in FIG. 6, an upper face of the beam-shaped unit 328 is located in the same plane of the first face F1 of the flow path substrate 32, and the lower face of the beam-shaped unit 328 is located between the first face F1 and the second face F2. Accordingly, the beam-shaped unit 328 and the compliance unit 54 face each other with a predetermined interval D1 in the Z direction.

As exemplified in FIG. 6, the surface of the beam-shaped unit 48 of the housing 40 on the flow path substrate 32 side is an inclined face which is inclined to the first face F1 (X-Y plane) of the flow path substrate 32. Specifically, the surface of the beam-shaped unit 48 according to the first embodiment includes a pair of inclined faces (planar face or curved face) which are located on the positive side and a negative side in the X direction by having a ridgeline which is parallel in the Y direction as a boundary. That is, a horizontal width (dimension in X direction) of the beam-shaped unit 48 gradually decreases from the negative side to the positive side in the Z direction. As is understood from FIG. 6, a width of the beam-shaped unit 328 of the flow path substrate 32 is larger than that of the beam-shaped unit 48 of the housing 40. In addition, as is understood from FIG. 6, the plurality of beam-shaped units 48 of the housing 40 are provided at a position which is separated from the first face F1 of the flow path substrate 32 on the negative side in the Z direction (side opposite to flow path substrate 32). Specifically, a predetermined gap D2 is secured between each beam-shaped unit 48 and the first face F1. As described above, since the bonding portion of the housing 40 is bonded to the first face F1, it can also be expressed that each beam-shaped unit 48 and the bonding face are separated by the gap D2, in other words.

FIG. 7 is an explanatory diagram of a process of installing the housing 40 on the first face F1 of the flow path substrate 32. As exemplified in FIG. 7, an adhesive is transferred to the bonding face (for example, base of side face portion 44) when mounting the housing 40 on a work face onto which the adhesive is applied in a uniform thickness, and the housing 40 is bonded to the flow path substrate 32 when the housing 40 to which the adhesive is transferred is arranged on the first face F1 of the flow path substrate 32. According to the first embodiment, since the plurality of beam-shaped units 48 are provided at a position of the housing 40 which is separated from the bonding face by the gap D2, it is possible to reduce a possibility that the adhesive may also be attached to the beam-shaped unit 48 along with the bonding face which is the original transfer target of the adhesive in the process of installing the housing 40 on the work face in FIG. 7. Accordingly, there is an advantage that it is possible to reduce a possibility that the adhesive which is attached to the beam-shaped unit 48, and is hardened may obstruct flowing of ink in the liquid storage chamber SR.

As described above, according to the first embodiment, since the liquid storage chamber SR and the pressure chamber SC communicate through the supply hole 322 (diaphragm flow path) which is formed in the flow path substrate 32, it is possible to reduce a size of the pressure chamber substrate 34 compared to a configuration in which the diaphragm flow path is formed in the pressure chamber space 342. Accordingly, it is possible to realize miniaturization of the liquid ejecting head 100. In addition, since the compliance unit 54 is provided in the vicinity of the pressure chamber SC so as to face the pressure chamber SC by interposing the communicating hole 324, there is an advantage that it is possible to efficiently absorb a pressure change which is propagated to the liquid storage chamber SR from each pressure chamber SC through the communicating hole 324 using the compliance unit 54. Meanwhile, in a configuration in which the flow path substrate 32 is reduced in size in order to miniaturize the liquid ejecting head 100, it is difficult to sufficiently secure an area of the compliance unit 54, and a possibility that a pressure change in the liquid storage chamber SR may not be sufficiently suppressed using only the compliance unit 54 is also assumed. According to the first embodiment, since the compliance unit 46 is provided in the housing 40, in addition to the compliance unit 54 of the flow path substrate 32, there is an advantage that it is possible to effectively suppress a pressure change in the liquid storage chamber SR even when the flow path substrate 32 is miniaturized compared to a configuration in which the compliance unit 46 is not provided.

Meanwhile, it is necessary to miniaturize the housing 40, as well, in order to miniaturize the liquid ejecting head 100; however, when the plate thickness of the side face portion 44 or the top face portion 42 is reduced in order to miniaturize the housing 40, there is a possibility that a mechanical strength of the housing 40 may be insufficient. According to the first embodiment, since the beam-shaped unit 48 is provided in the housing 40, there is an advantage that it is possible to maintain the mechanical strength of the housing 40 even in a configuration in which the plate thickness of each unit is reduced in order to miniaturize the housing 40. According to the first embodiment, since the beam-shaped unit 328 is provided in the flow path substrate 32, in addition to the beam-shaped unit 48 of the housing 40, there is also an advantage that it is possible to maintain the mechanical strength of the flow path substrate 32 (and entire strength of liquid ejecting head 100).

Second Embodiment

A second embodiment of the invention will be described. In each embodiment which is exemplified below, elements of which operations or functions are the same as those in the first embodiment will be given the reference numerals which are used in the first embodiment, and detailed descriptions thereof will be appropriately omitted.

FIG. 8 is a sectional view of a liquid ejecting head 100 according to a second embodiment, and FIG. 9 is a plan view of the liquid ejecting head 100 which is viewed from the negative side in the Z direction. In FIG. 9, a subscript 1 is added to the end of a reference numeral of an element corresponding to a plurality of nozzles N in the first column L1, and a subscript 2 is added to the end of a reference numeral of an element corresponding to a plurality of nozzles N in the second column L2. As exemplified in FIG. 9, in a top face portion 42 of a housing 40 of the liquid ejecting head 100 according to the second embodiment, an introducing port 431 corresponding to the plurality of nozzles N of the first column L1, and an introducing port 432 corresponding to the plurality of nozzles N of the second column L2 are arranged in the X direction. The housing 40 according to the second embodiment is formed by the same resin material, such as LCP, as that in the first embodiment.

An inner wall face of a liquid storage chamber SR1 (space R2) corresponding to the first column L1 includes an inclined face 471 which extends on the negative side in the Y direction from the introducing port 431 in a planar view, and an inner wall face of a liquid storage chamber SR2 corresponding to the second column L2 includes an inclined face 472 which extends on the positive side in the Y direction from the introducing port 432 of the second column L2 in a planar view. As is understood from FIG. 8, the inclined faces 471 and 472 are planar faces or curved faces which are inclined to an X-Y plane. As is understood from the above descriptions, ink which is supplied to the introducing port 43 from the liquid container 14 flows to the side face portion 44 side (negative side in Y direction) along the inclined face 47 in the liquid storage chamber SR, as illustrated in FIG. 8 using a dashed arrow.

In contrast to the first embodiment in which the opening portion 422 is formed on the top face portion 42 of the housing 40, as exemplified in FIG. 8, in the second embodiment, the opening portion 442 is formed on the side face portion 44 of the housing 40. Specifically, the side face portion 44 is formed in a rectangular frame shape which has a foundation portion 445 which extends in the X direction along the peripheral edge of the flow path substrate 32 as a bottom. A base of the foundation portion 445 is bonded to the first face F1 of the flow path substrate 32 using an adhesive, for example, as a bonding face. Accordingly, the foundation portion 445 protrudes on the negative side in the Z direction from the first face F1. As exemplified in FIG. 8, the compliance unit 46 according to the second embodiment seals the opening portion 442 by being provided on the outer wall face of the side face portion 44. That is, the compliance unit 46 is fixed to the rectangular frame-shaped outer wall face which includes the surface of the foundation portion 445. A configuration in which the compliance unit 54 is provided on the second face F2 of the flow path substrate 32 is the same as that in the first embodiment. That is, the compliance unit 46 according to the second embodiment is perpendicularly arranged with respect to the first face F1 of the flow path substrate 32 or the compliance unit 54. As is understood from the above descriptions, also in the second embodiment, both the compliance unit 54 which is provided in the flow path substrate 32 and the compliance unit 46 which is provided in the housing 40 are used in order to absorb the pressure change in the liquid storage chamber SR, similarly to the first embodiment.

As exemplified in FIG. 8, a plurality of beam-shaped units 48 the same as those in the first embodiment are provided on the inner wall face of the foundation portion 445 in the side face portion 44. Specifically, the plurality of beam-shaped units 48 are arranged along the foundation portion 445 which extends in the X direction with intervals therebetween. The plurality of beam-shaped units 48 are located on the negative side in the Z direction by the gap D2 with respect to the first face F1 (or, bonding face which is base of foundation portion 445) of the flow path substrate 32. A configuration of the beam-shaped unit 328 of the flow path substrate 32 is the same as that in the first embodiment.

The same effects as those in the first embodiment are obtained also in the second embodiment. In the second embodiment, since the opening portion 442 is formed in the side face portion 44, particularly, the foundation portion 445 tends to be short in mechanical strength in the side face portion 44. According to the second embodiment, since the beam-shaped unit 48 is provided in the foundation portion 445, there is an advantage that it is possible to effectively reinforce the mechanical strength of the foundation portion 445.

In addition, according to the second embodiment, since the compliance unit 46 is provided in the side face portion 44 of the housing 40, it is possible to improve a performance of absorbing a pressure change in the liquid storage chamber SR while reducing a size of the liquid ejecting head 100 which is viewed in the Z direction (size in X-Y plane) compared to the first embodiment in which the compliance unit 46 is provided on the top face portion 42. Meanwhile, in the first embodiment, since the compliance unit 46 is provided on the top face portion 42, there is an advantage that it is possible to secure a performance of absorbing a pressure change in the liquid storage chamber SR, while reducing a height of the housing 40 (size in Z direction) compared to the second embodiment in which the compliance unit 46 is provided in the side face portion 44. In addition, when the height of the housing 40 is further reduced, for example, it is possible to further shorten a distance for moving bubbles which is performed in order to discharge the bubbles which are mixed into ink in the liquid storage chamber SR from the nozzle N. That is, when considering discharging of bubbles, the first embodiment is advantageous compared to the second embodiment.

In addition, in a configuration in which the side face portion 44 of the housing 40 does not included the foundation portion 445 (for example, configuration in which bottom of opening portion 442 is defined by the first face F1 of the flow path substrate 32, and hereinafter, referred to as "comparison example"), the compliance unit 46 is provided over the outer wall face of the side face portion 44 and the side end face of the flow path substrate 32. According to the second embodiment, since the compliance unit 46 is provided on the outer wall face of the side face portion 44 which includes the surface of the foundation portion 445 in the housing 40, the compliance unit 46 is firmly fixed compared to the comparison example in which the compliance unit 46 is provided over both sides of the outer wall face of the side face portion 44 and the side end face of the flow path substrate 32. Accordingly, there is an advantage that it is possible to reduce a possibility of a malfunction such as leakage of ink from a bonding portion of the compliance unit.

Third Embodiment

FIG. 10 is a sectional view of a liquid ejecting head 100 according to a third embodiment. In a housing 40 according to the third embodiment, two introducing ports 43 are arranged in the X direction, similarly to those in the second embodiment which is exemplified in FIG. 9, and the inner wall face of a liquid storage chamber SR includes inclined faces 47 (471 and 472). As exemplified in FIG. 10, the housing 40 of the liquid ejecting head 100 according to the third embodiment includes an inclined portion 49 of which the outer wall face is inclined to the first face F1 (X-Y plane) of the flow path substrate 32. Specifically, the inclined portion 49 is a portion which is approximately parallel to the inclined face 47 of the liquid storage chamber SR. The housing 40 according to the third embodiment is formed by the same resin material, such as LCP, as that in the first embodiment.

According to the third embodiment, an opening portion 492 is formed in the inclined portion 49 of the housing 40. The compliance unit 46 according to the third embodiment seals the opening portion 492 by being provided on the outer wall face of the inclined portion 49. The configuration in which the compliance unit 54 is provided on the second face F2 of the flow path substrate 32 is the same as that in the first embodiment. Accordingly, the compliance unit 46 according to the second embodiment is inclined to the first face F1 of the flow path substrate 32 or the compliance unit 54. As is understood from the above descriptions, also in the third embodiment, both of the compliance unit 54 which is provided in the flow path substrate 32 and the compliance unit 46 which is provided in the housing 40 are used in order to absorb a pressure change in the liquid storage chamber SR, similarly to the first embodiment. In addition, configurations of the beam-shaped unit 328 of the flow path substrate 32 and the beam-shaped unit 48 of the housing 40 are the same as those in the first embodiment.

In the third embodiment, it is also possible to obtain the same effects as those in the first embodiment. In addition, according to the third embodiment, the compliance unit 46 is provided on the outer wall face of the inclined portion 49 of the housing 40. Accordingly, there are advantages that it is possible to reduce a size of the liquid ejecting head 100 in the X-Y plane compared to the configuration in which the compliance unit 46 is provided in parallel to the flow path substrate 32 as in the first embodiment, and to reduce a size of the liquid ejecting head 100 in the Z direction compared to the configuration in which the compliance unit 46 is provided perpendicularly to the flow path substrate 32 as in the second embodiment, for example.

In addition, for example, in the configuration in which the top face portion 42 and the side face portion 44 are approximately orthogonal to each other as in the first and second embodiments, ink tends to stagnate at a portion in the inside of a corner portion (for example, region a in FIG. 8) in the liquid storage chamber SR at which the top face portion 42 intersects the side face portion 44. According to the third embodiment, since the housing 40 includes the inclined portion 49, smooth flow of ink in the liquid storage chamber SR is promoted compared to the first embodiment or the second embodiment. Accordingly, there is an advantage that it is possible to reduce a possibility of stagnation of bubbles which are mixed into ink in the liquid storage chamber SR.

Modification Example

Each embodiment which is exemplified above can be variously modified. Specific modification example will be described below. Two or more examples which are arbitrarily selected from the following examples can be appropriately combined in a range of not conflicting each other.

(1) In each embodiment which is described above, one housing 40 is provided with respect to one flow path substrate 32; however, as exemplified in FIG. 11, it is also possible to provide one housing 72 with respect to a plurality of the flow path substrates 32. Each of a plurality of liquid ejecting units 70 which are exemplified in FIG. 11 is an element other than the housing 40 in the liquid ejecting head 100 in each of the above described embodiments. That is, one arbitrary liquid ejecting unit (head chip) 70 includes a flow path substrate 32, a pressure chamber substrate 34, a vibrating unit 36, a plurality of piezoelectric elements 37, a protecting member 38, a nozzle plate 52, and a compliance unit 54. As exemplified in FIG. 11, one housing 72 is commonly provided with respect to the flow path substrate 32 of the plurality of liquid ejecting units 70. A plurality of spaces R2 (not illustrated) corresponding to the liquid ejecting units 70 which are different from each other are formed in the housing 72, and communicate with the space R1 of the flow path substrate 32 of each liquid ejecting unit 70. An opening portion 722 which is formed over the plurality of liquid ejecting units 70 is formed on the side face of the housing 72, and a compliance unit 74 (exemplified second compliance unit) which seals the opening portion 722 is provided on the outer wall face of the housing 72. That is, one compliance unit 74 is commonly used over the plurality of liquid ejecting units 70. According to the configuration in FIG. 11, there is an advantage that it is possible to make a configuration of the liquid ejecting head 100 simple compared to a configuration in which the housing 72 and the compliance unit 74 are individually provided in each of the liquid ejecting units 70. In addition, in FIG. 11, the compliance unit 74 is provided on the side face of the housing 72; however, it is also possible to provide the compliance unit 74 which is formed over the plurality of liquid ejecting units 70 on a top face (upper face) of the housing 72.

(2) According to the first embodiment, the compliance unit 46 is provided on the top face portion 42 of the housing 40, and according to the second embodiment, the compliance unit 46 is provided on the side face portion 44 of the housing 40; however, it is also possible to provide the compliance unit 46 on both faces of the top face portion 42 and the side face portion 44 of the housing 40. In addition, it is also possible to adopt a configuration in which the compliance unit 46 is provided on at least one of the inclined portion 49, the top face portion 42, and the side face portion 44 of the housing 40 which are exemplified in the third embodiment.

(3) The element (driving element) which applies a pressure into the pressure chamber SC is not limited to the piezoelectric element 37 which is exemplified in each embodiment which is described above. For example, it is also possible to use a heating element which causes a pressure change by generating bubbles in the inside of the pressure chamber SC using heating, as a driving element. As is understood from the above examples, the driving element is comprehensively expressed as an element for ejecting liquid (typically, element which applies pressure into pressure chamber SC), and an operation method (piezoelectric method or heating method) or specific configuration thereof does not matter.

(4) In each embodiment which is described above, the beam-shaped unit 48 is integrally formed with the housing 40; however, it is also possible to fix a beam-shaped unit 48 which is a separate body from the housing 40 to the housing 40. The same is applied to the beam-shaped unit 328 of the flow path substrate 32, and it is also possible to fix the beam-shaped unit 328 which is a separate body from the flow path substrate 32 to the flow path substrate 32. In addition, it is also possible to omit at least one of the beam-shaped unit 48 and the beam-shaped unit 328.

(5) In each embodiment which is described above, a serial head in which the carriage 26 on which the plurality of liquid ejecting heads 100 are mounted moves in the Y direction is exemplified; however, it is also possible to apply the invention to a line head in which a plurality of liquid ejecting heads 100 are arranged in the Y direction.

(6) The printing apparatus 10 which is exemplified in each embodiment which is described above can be adopted to various devices such as a fax machine or a copy machine, in addition to a device which is exclusive to printing. Originally, a use of the liquid ejecting apparatus in the invention is not limited to printing. For example, a liquid ejecting apparatus which ejects a solution of a coloring material is used as a manufacturing device which forms a color filter of a liquid crystal display device. In addition, a liquid ejecting apparatus which ejects a solution of a conductive material is used as a manufacturing device which forms wiring or an electrode of a wiring substrate.

REFERENCE SIGNS LIST

10 Printing apparatus (liquid ejecting apparatus)
12 Medium
14 liquid container
22 Control device
24 Transport mechanism
26 Carriage
100 liquid ejecting head
32 Flow path substrate
322 Supply hole
324 Communicating hole
326 Branching path
328 Beam-shaped unit
34 Pressure chamber substrate
342 pressure chamber space
36 Vibrating unit
37 Piezoelectric element
38 Protecting member
40 Housing
42 Top face portion
43 Introducing port
44 Side face portion
46 Compliance unit
48 Beam-shaped unit
49 Inclined portion
52 Nozzle plate
54 Compliance unit
SR liquid storage chamber
SC Pressure chamber
N Nozzle

The invention claimed is:

1. A liquid ejecting head comprising:
a pressure chamber substrate on which pressure chamber spaces are formed;
a flow path substrate which includes a first face on which the pressure chamber substrate is provided, and a second face on a side opposite to the first face, and on which a first space, a supply hole which causes the first space and the pressure chamber space to communicate, and a communicating hole which communicates with the pressure chamber space are formed;
a nozzle plate which is different from the flow path substrate and which is provided on the second face of the flow path substrate, and on which nozzles which communicate with the communicating hole are formed;
a housing which is provided on the first face of the flow path substrate, and in which a second space which communicates with the first space of the flow path substrate, and an opening portion which communicates with the second space are formed;
a flexible first compliance unit which is provided on the second face of the flow path substrate, and seals the communicating hole and the first space; and
a flexible second compliance unit which seals the opening portion of the housing.

2. The liquid ejecting head according to claim 1,
wherein the housing includes a top face portion which is located on a side opposite to the flow path substrate by interposing the second space therebetween,
wherein the opening portion is formed on the top face portion, and
wherein the second compliance unit is provided on an exterior wall face of the top face portion.

3. The liquid ejecting head according to claim 1,
wherein the housing includes a side face portion which protrudes from the first face,
wherein the opening portion is formed on the side face portion, and
wherein the second compliance unit is provided on an exterior wall face of the side face portion.

4. The liquid ejecting head according to claim 3,
wherein the side face portion includes a foundation portion which protrudes from the first face along a peripheral edge of the flow path substrate, and
wherein the second compliance unit is provided on the exterior wall face of the side face portion including a front surface of the foundation portion.

5. The liquid ejecting head according to claim 1,
wherein the side face portion includes an inclined portion of which an exterior wall face is inclined to the flow path substrate,
wherein the opening portion is formed in the inclined portion, and
wherein the second compliance unit is provided on an exterior wall face of the inclined portion.

6. A liquid ejecting apparatus comprising:
the liquid ejecting head according to any one of claim 1.

7. A liquid ejecting head comprising:
a pressure chamber substrate on which pressure chamber spaces are formed;
a flow path substrate which includes a first face on which the pressure chamber substrate is provided, and a second face on a side opposite to the first face, and on which a first space, a supply hole which causes the first space and the pressure chamber space to communicate, and a communicating hole which communicates with the pressure chamber space are formed;

a nozzle plate which is provided on the second face of the flow path substrate, and on which nozzles which communicate with the communicating hole are formed;

a housing which is provided on the first face of the flow path substrate, and in which a second space which communicates with the first space of the flow path substrate, and an opening portion which communicates with the second space are formed;

a flexible first compliance unit which is provided on the second face of the flow path substrate, and includes a flexible film, and seals the communicating hole and the first space; and a flexible second compliance unit which includes a flexible film, and seals the opening portion of the housing.

* * * * *